United States Patent [19]

Hammett et al.

[11] Patent Number: 4,872,595

[45] Date of Patent: Oct. 10, 1989

[54] MECHANICALLY PRESSURIZED AEROSOL DISPENSER

[76] Inventors: Roy Hammett, 16103 Carden Dr., Odessa, Fla. 33556; Jerry D. Hutcheson, 8188 S. Harrison Way, Littleton, Colo. 80122; Raymond B. Avedon, 2821 N. Lakeridge Trail, Boulder, Colo. 80302

[21] Appl. No.: 249,956

[22] Filed: Sep. 27, 1988

[51] Int. Cl.[4] ..... B65D 37/00; B65D 88/54; B67D 5/42

[52] U.S. Cl. ..... 222/209; 222/252; 222/383; 222/386.5; 239/333; 417/540

[58] Field of Search ..... 222/207, 209, 252, 255, 222/340, 379, 380, 383, 386.5, 387, 398, 402.1, 402.2; 239/333; 417/540

[56] References Cited

U.S. PATENT DOCUMENTS

| | | | |
|---|---|---|---|
| 3,790,034 | 2/1974 | Horvath | 222/340 |
| 3,792,800 | 2/1974 | Capra et al. | 222/340 |
| 3,940,029 | 2/1976 | Horvath | 222/340 |
| 4,174,052 | 11/1979 | Capra et al. | 222/340 |
| 4,222,500 | 9/1980 | Capra et al. | 222/383 |
| 4,241,853 | 12/1980 | Pauls et al. | 222/340 |
| 4,260,082 | 4/1981 | Rooney et al. | 222/340 |

*Primary Examiner*—Joseph J. Rolla
*Assistant Examiner*—Steven M. Reiss
*Attorney, Agent, or Firm*—Dennis H. Lambert

[57] ABSTRACT

A dispenser which includes an elastic reservoir for sustaining pressure on material to be dispensed from the reservoir includes a rotatable actuator for actuating a piston for charging the reservoir. The charging piston is integral with the actuator, and the chamber or cylinder for the piston, as well as the reservoir support are integral with the container, thereby providing for a simple construction.

10 Claims, 4 Drawing Sheets

MECHANICALLY PRESSURIZED AEROSOL DISPENSER

FIELD OF THE INVENTION

This invention relates in general to dispensers for dispensing materials under pressure, especially consumer products, and in particular relates to such a dispenser which relies upon a mechanical means for the pressure source.

DESCRIPTION OF THE PRIOR ART

Aerosol dispensers have been in use for more than forty years, and continue to gain in popularity because of their convenience of use. Most such dispensers require the use of chemical propellants, such as chlorofluorocarbons, to pressurize the product. However, the use of chemical propellants in aerosol dispensers gives rise to many problems, including the necessity of exercising special precautions in filling and handling the dispensers. For instance, the propellant used in these dispensers is contained under pressure, and may cause an explosion if special care is not taken in shipping, storing and disposing of them. Additionally, and perhaps of even greater concern is the recent disclosure that the ozone layer in the earth's atmosphere is in danger of being depleted or damaged by various chemicals released into the atmosphere, including the chemicals used in propellant actuated aerosol dispensers.

At least partially to solve these problems with propellant-actuated aerosol dispensers, various mechanically actuated dispensers have been developed. Such dispensers include finger-actuated pumps and triggers. Both of these types of dispensers require a continued vigorous pumping to achieve even a semblance of a continuous spray. Prolonged use is accompanied by finger fatigue, and it is difficult to achieve accurate dispensing of product because of the involuntary move ment of the user during the pumping action. Further, such hand pumping devices are inconvenient to use and do not create substantial consumer demand, although they have found acceptance because of the absence of toxic and dangerous chemicals.

Other prior art devices utilize various constructions to obtain prolonged spray time by the use of manually pressurized reservoirs. Such prior art devices are illustrated, for example, in U.S. Pat. Nos. 4,105,145, 4,167,941, 4,174,052, 4,174,055, 4,176,764, 4,222,500, 4,222,501, 4,235,353 and 4,241,853. However, such prior art devices are relatively complex and expensive in construction and manufacture, or are difficult and clumsy to operate.

Conventional aerosol dispensers must also generally be operated in an upright position in order to maintain the dip tube immersed in the product, or to avoid the loss of propellant.

SUMMARY OF THE INVENTION

The present invention provides a dispenser which is simple and economical in construction, and which may be operated in any orientation, even upside down. The dispenser of the invention includes an elastic reservoir for sustaining pressure on material to be dispensed from the reservoir, plus a piston which is actuated with a twisting motion on an actuator for charging the reservoir. A manually operated valve is connected with the reservoir for selectively releasing material from the reservoir once it has been charged. Further, the charging piston may be formed integrally with the twist actuator, and may reciprocate in a charging chamber formed integrally with the reservoir support, thereby providing for a simple construction. Thus, the problems of the prior art devices of complicated construction are solved, and the use of an elastic reservoir to pressurize the material to be dispensed eliminates the need for chemical propellants.

An object of the invention is, therefore, to provide an aerosol dispenser which is pressurized mechanically, eliminating the need for chemical propellants.

Another object of the invention is to provide an aerosol dispenser which is simple and economical in construction.

Yet another object of the invention is to provide an aerosol dispenser which may be operated in any orientation, even upside down.

BRIEF DESCRIPTION OF THE DRAWINGS

The foregoing and other objects and advantages of the invention will become apparent from the following detailed description and claims when considered in conjunction with the accompanying drawings, in which like reference characters designate like parts throughout the several views, and wherein:

DESCRIPTION OF THE PREFERRED EMBODIMENTS

Figure 1:
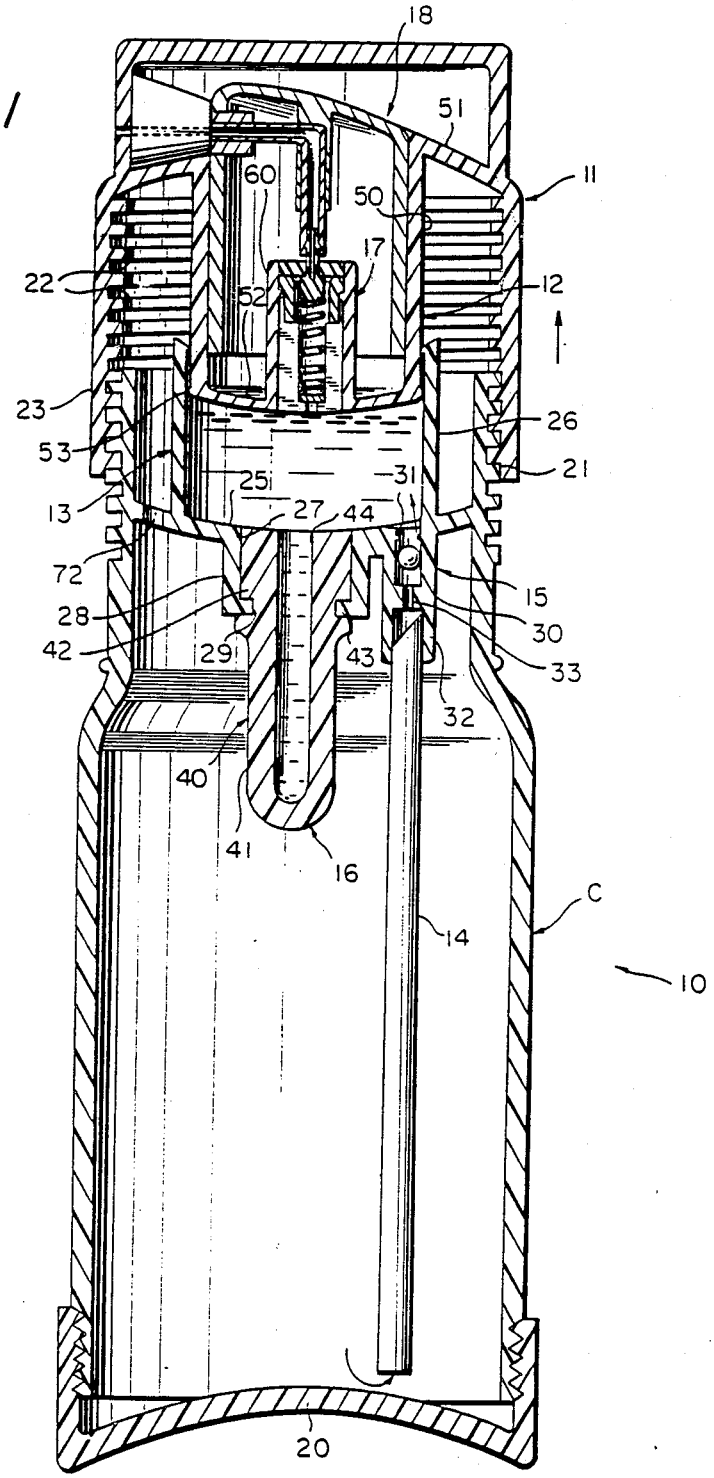
FIG. 1 is a longitudinal sectional view of the dispenser of the invention, shown on a reusable container, and with the actuator being moved to draw product from the container into the charging chamber.
Figure 2:
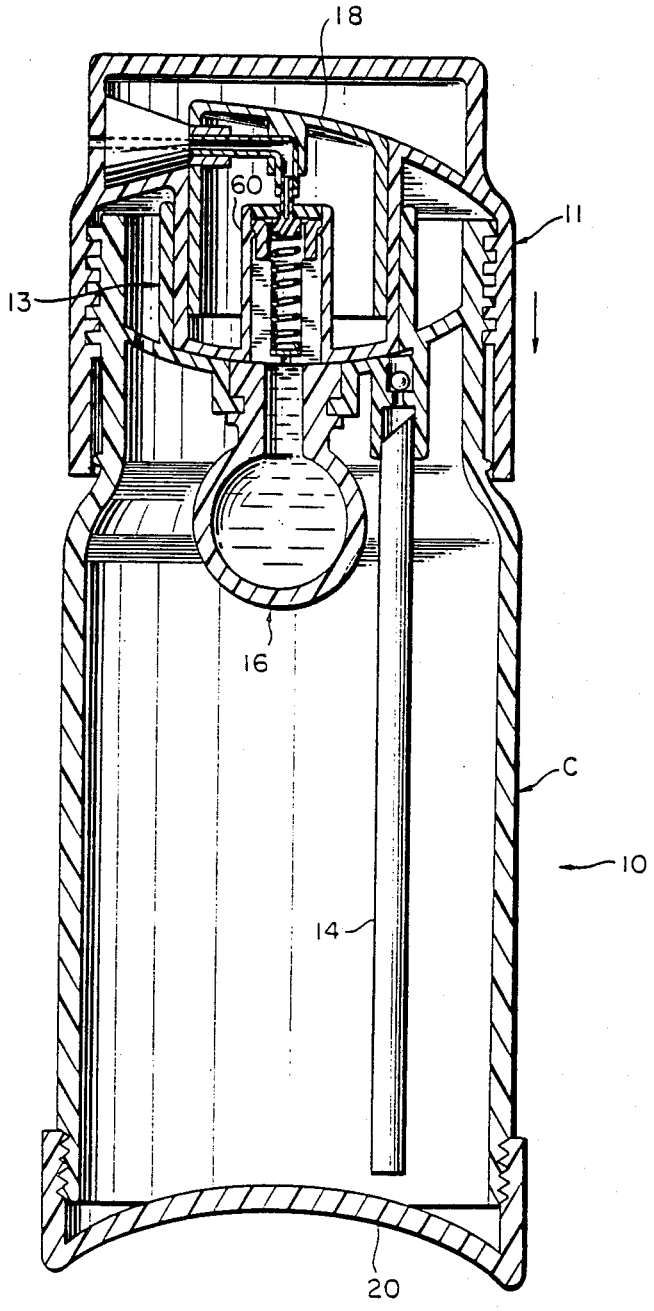
FIG. 2 is a longitudinal sectional view similar to FIG. 1, but showing the actuator moved to a position to charge the material into the reservoir.

With more particular reference to the drawings, an aerosol dispenser in accordance with the invention is indicated generally at 10 in FIGS. 1 and 2. The dispenser comprises a container C, with an actuator 11 engaged thereon and carrying a charging piston 12 for reciprocating movement in a charging chamber 13 formed in the container. Upward movement of the piston draws product P from the container and upwardly through dip tube 14 and one way check valve 15 into the charging chamber 13. A resiliently yieldable pressure reservoir 16 is carried by the container adjacent the charging chamber for receiving product from the charging chamber when the piston is caused to move downwardly in the charging chamber. A discharge valve assembly 17 communicates with the pressure reservoir to release the pressurized product therefrom upon depression of the nozzle button 18.

In the particular example shown, the container C is indicated as being refillable, with a screw-on bottom closure 20. It should be understood, however, that the dispenser could equally as well be made disposable, in which case the removable closure 20 could be eliminated. In such instance, the closure 20 could be snap-engaged on the bottom of the container after molding, or the bottom of the container could be made integral with the side wall of the container. In the latter instance, it would be necessary to separately form the top portion of the container and then apply it through a snap fit to the container side wall (see FIG. 5, described hereinafter).

The container C is formed with integral screw threads 21 on an outer upper end surface thereof, and the actuator 11 has complemental screw threads 22 formed in the depending skirt 23, whereby one rotation of the actuator in a counterclockwise direction moves the piston 12 fully upwardly in the charging chamber 13 to draw product into and fill the charging chamber, as shown in FIG. 1. One rotation of the actuator in a clockwise direction serves to move the product from the charging chamber into the pressure reservoir 16, as shown in FIG. 2, expanding the pressure reservoir and storing the product under pressure. The ball check valve 15 closes upon the pressurizing stroke of the piston, preventing return of the product back down the dip tube and into the container. Similarly, the discharge valve 17 is closed during this time, preventing discharge of product. It should be noted, however, that the metal ball check valve, seating on the plastic valve seat, will permit a slow leak back (2–4 minutes, for example) of product into the container in the event the pressure reservoir is charged with product that is not dispensed. If desired, a roughened surface (not shown) could be provided on the ball, or a restricted passage (not shown) could be provided in the seat, etc., for permitting a faster leak back when toxic materials are being dispensed. This feature constitutes a safety feature, and also prevents set or creep in the reservoir which might be caused if it were permitted to sit in an extended position as charged with product.

The charging reservoir 13 is integrally formed with the container, and comprises a transverse wall 25 extending across the upper end of the container, spaced below the terminal, free end thereof and having an open ended up-standing cylindrical wall 26. A central opening 27 is formed in the wall 25, and a depending cylindrical wall 28 with an inturned flange 29 on the bottom end thereof extends downwardly below the opening.

A check valve housing 30 is also formed integrally with the wall 25, projecting downwardly therefrom and communicating with an inlet opening 31 formed through the wall 25 in the area bounded by the charging chamber wall 26. A tail piece 32 extends below the ball seat 33 for retaining the upper end of the dip tube.

The pressure reservoir 16 comprises an elastomeric bladder 40 having an expandable wall 41 and an attaching flange 42 with a retaining and sealing channel 43 in an outer surface thereof. The flange 42 is snugly received in the space bounded by the wall 28, and the flange 29 on the bottom end of the wall 28 is engaged in the retaining channel 43, securely holding the bladder to the wall 25. The upper end of the bladder is open at 44 to the charging chamber, whereby product is enabled to flow freely into and out of the bladder. The bladder may be made of any suitable material, depending upon the product to be dispensed, the pressure desired, etc., and may be sized to produce a desired time and/or volume of product discharge. In this connection, however, it should be noted that the pitch of the threads on the container and actuator may also have to be altered.

The charging piston 12 is integrally formed with the actuator 11, and comprises a cylindrical wall 50 depending from the end wall 51 of the actuator and having a closed lower end 52. A flexible sealing lip 53 may be formed on the bottom outer margin of the piston for obtaining a more effective sliding seal with the charging chamber wall, if desired.

Figure 3:
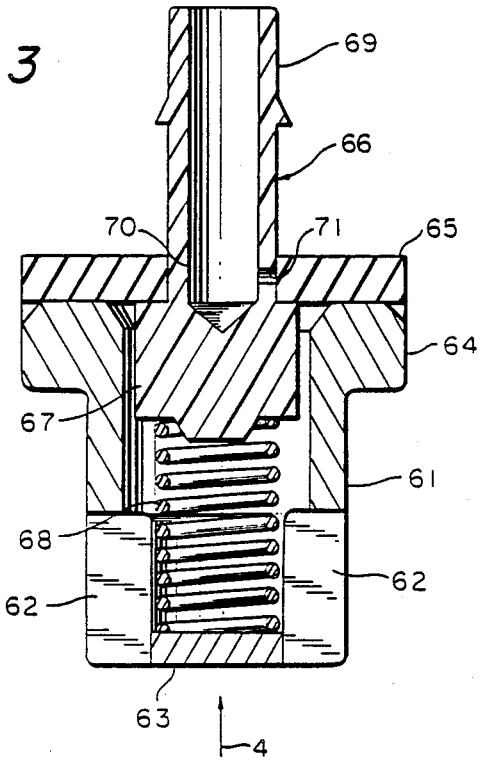
FIG. 3 is a greatly enlarged longitudinal sectional view of the dispensing valve used in the system of the invention.
Figure 4:
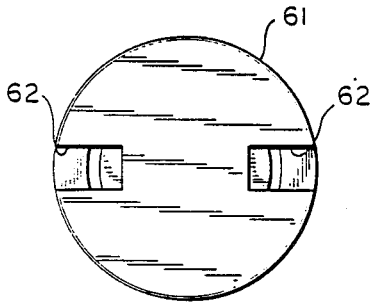
FIG. 4 is an end view looking in the direction of the arrow 4 in FIG. 3.

The discharge valve assembly 17 is carried in the bottom wall 52 of the piston 12, and includes a housing 60 formed integrally with the wall 52 and projecting upwardly therefrom. As seen best in FIGS. 3 and 4, the valve comprises a retainer 61 having its lower end slotted at 62, with means 63 defining a spring seat. A radially outwardly directed flange 64 is formed on the upper end of the retainer for securing the assembly in the housing 60, and a relatively soft seat gasket 65 is engaged over the flange 64. A closure valve 66 is reciprocable in the retainer and includes an enlarged head 67 positioned to seat upwardly against the gasket 65 under the influence of spring 68. A valve stem 69 is formed integrally with the valve head and extends upwardly through an opening 70 in the gasket for cooperation with the nozzle button 18 to depress the valve stem and unseat the valve head from the gasket. The stem is hollow and a side port 71 is formed through the stem closely adjacent the head, so that as soon as the head is unseated, flow can occur from the bladder, upwardly through the slotted retainer, into the port 71 and thence outwardly through the nozzle (not shown).

A vent opening 72 is formed through the wall 25 for venting the interior of the container to atmosphere to relieve vacuum created by dispensing of product from the container. The vent opening may be closed by a suitable valve, such as a flap valve or the like (not shown), if desired, to prevent leakage of product from the container through the vent opening. Alternatively, the vent opening could comprise a small capillary passage capable of admitting air, but too small to pass product.

Figure 5:
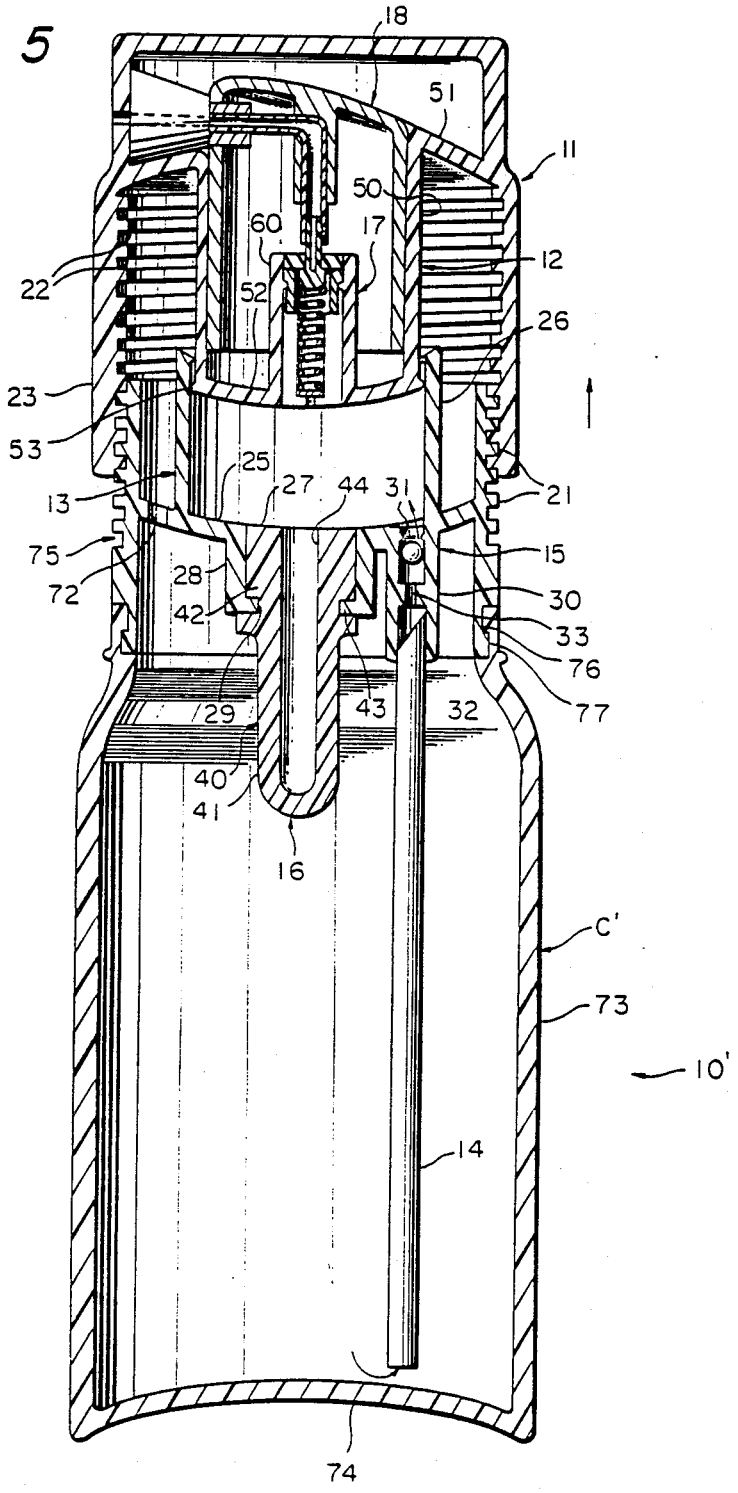
FIG. 5 is a view similar to FIG. 1 of a modified version of the invention, wherein the bottom of the container is integrally formed, and the top portion is separately made and then attached.

In the version shown at 10, in FIG. 5, the container C, has a side wall 73 formed with an integral bottom 74, and the top portion or neck 75 of the container is separately formed and then snap-fitted to the side wall through snap-engaging shoulders 76 and 77 on the wall and top, respectively. This is done to enable molding of the retainer wall nd cylinder as integral parts of the container.

In addition, the wall 26 of chamber 13 could be moved outwardly to enlarge the bore of the chamber, thereby enabling the length or stroke of the chamber to be reduced and still have the same volume.

The dispenser of the invention may be used or modified for use to dispense gels, liquids, pastes, and the like, and may be operated to dispense product in any orientation of the container. Moreover, since there are no chemical propellants used, the dispenser of the invention does not require special handling considerations during filling, storage and/or shipment, and there are no toxic chemicals to cause concern if used in a closed environment, or to potentially damage the earth's atmospheric ozone layer.

The dispenser may be made refillable or disposable, as desired, and may incorporate any suitable materials, container shapes, and discharge times or volumes.

The dispenser of the invention is simple and economical to make, and requires a minimal number of parts, thereby simplifying assembly and inventory of parts. The use of integrally formed components also reduces the potential of leakage around assembled parts. The container and actuator may be molded with relatively simple molding equipment, using straight draw cores (with the exception of the threads, which require an unscrewing action in the respective mold parts).

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

We claim:

1. A mechanically pressurized dispensing device comprising:

a container having an open, top end and a closed, bottom end;

rotatable actuator means engaged with one end of the container and connected with a first expansible chamber means to enlarge the volume of the chamber to draw product to be dispensed from the container and into the chamber when the actuator means is rotated in a first direction and then to reduce the volume of the chamber to pressurize the product when the actuator means is rotated in a second direction;

a second expansible chamber means connected to receive pressurized product from the first expansible chamber means when the actuator means is rotated in said second direction and to store the product under pressure for dispensing; and a discharge valve connected with the second expansible chamber means to release the pressurized product therefrom for dispensing the product;

said first expansible chamber means including a piston and cylinder, one of the piston and cylinder being formed integrally with said container and the other of said piston and cylinder being formed integrally with said actuator.

2. The device as claimed in claim 1, wherein:

the second expansible chamber means is carried and supported by a retainer wall formed integrally with said container, said retainer wall comprising one wall of said first expansible chamber means.

3. The device as claimed in claim 2, wherein:

the second expansible chamber means comprises an elastomeric bladder having an open end and a closed end, said open end being fixed and retained in an opening through said retaining wall.

4. The device as claimed in claim 3, wherein:

an inlet opening is formed through said retaining wall in the space bounded by the first expansible chamber wall; and a dip tube is connected at one end with said opening, said dip tube extending at its other end into proximity with the closed end of the container.

5. The device as claimed in claim 4, wherein:

a one way check valve is positioned in said inlet opening to enable flow from the container through the dip tube and into the first expansible chamber means but to prevent reverse flow.

6. The device as claimed in claim 5, wherein:

said discharge valve is positioned in and carried by said piston.

7. The device as claimed in claim 6, wherein:

said actuator means is carried by the open end of the container; and a removable closure is secured on the other end of the container, whereby the container may be refilled with product to be dispensed.

8. The device as claimed in claim 5, wherein:

said one way check valve permits slow leak-back of product from the first and second expansible chamber means into the container.

9. The device as claimed in claim 1, wherein:

the container is refillable and includes a removable bottom closure.

10. The device as claimed in claim 1, wherein:

the container is disposable and has a side wall with a integrally formed bottom wall; and a separately formed top portion is secured to the side wall of the container, said actuator means and said first and second expansible chamber means being in said top portion.

* * * * *